US009931579B1

(12) United States Patent
Garcia et al.

(10) Patent No.: US 9,931,579 B1
(45) Date of Patent: Apr. 3, 2018

(54) TOY HAVING MULTIPLE SERIAL SURPRISE REVEALS

(71) Applicant: MGA Entertainment, Inc., Van Nuys, CA (US)

(72) Inventors: Paula Garcia, Burbank, CA (US); Ione Jefferies, Los Angeles, CA (US); Blanche Consorti, Los Angeles, CA (US); Cathy Martin, Tarzana, CA (US)

(73) Assignee: MGA Entertainment, Inc., Van Nuys, CA (US)

( * ) Notice: Subject to any disclaimer, the term of this patent is extended or adjusted under 35 U.S.C. 154(b) by 0 days.

(21) Appl. No.: 15/471,973

(22) Filed: Mar. 28, 2017

Related U.S. Application Data

(60) Provisional application No. 62/447,274, filed on Jan. 17, 2017.

(51) Int. Cl.

| | |
|---|---|
| ***A63H 3/00*** | (2006.01) |
| ***A63H 3/36*** | (2006.01) |
| ***A63H 3/52*** | (2006.01) |
| ***B65D 33/04*** | (2006.01) |
| ***B65D 25/20*** | (2006.01) |
| ***B65D 25/10*** | (2006.01) |
| ***B65D 75/58*** | (2006.01) |

(52) U.S. Cl.
CPC ..... *A63H 3/36* (2013.01); *A63H 3/52* (2013.01); *B65D 25/10* (2013.01); *B65D 25/205* (2013.01); *B65D 33/04* (2013.01); *B65D 75/58* (2013.01)

(58) Field of Classification Search
CPC ..... B65D 25/205; B65D 25/10; B65D 75/58
USPC ..... 446/268; 206/459.5
See application file for complete search history.

(56) References Cited

U.S. PATENT DOCUMENTS

| | | | | |
|---|---|---|---|---|
| 2,424,538 | A | 7/1947 | Beder | |
| 2,839,869 | A | 6/1958 | Lopez | |
| 3,546,789 | A | 12/1970 | Kushell et al. | |
| 3,948,528 | A * | 4/1976 | Goodman, Jr | A45C 3/06 273/286 |

(Continued)

OTHER PUBLICATIONS

Wikipedia Article regarding "Kinder Sopresa" product, believed to have been first sold in 1974.

(Continued)

*Primary Examiner* — Vishu Mendiratta
(74) *Attorney, Agent, or Firm* — Intellectual Property Law Offices of Joel Voelzke, APC

(57) ABSTRACT

A toy includes a number of play objects that constitute surprises or prizes that are serially revealed to the child as the child removes various layers of wrappings from the toy. Some play objects are located between layers of wrapping. Other play objects are tucked into outer recesses of a spherical shell which is covered by the wrappings, such that removing one of the layers of wrappings reveals one compartment containing one play object at a time. Once all of the wrappings have been removed, the shell comes apart into halves, thus revealing yet another play object. The play object within the shell can be a toy figure such as a doll, with other play objects that were previously revealed being clothing, accessories for the doll, or cards that contain information or other indicia that has a play relationship to the toy figure. The objects that are serially revealed bear a play relationship with one another.

1 Claim, 11 Drawing Sheets

(56) References Cited

U.S. PATENT DOCUMENTS

| | | | | |
|---|---|---|---|---|
| 4,197,670 | A | 4/1980 | Cox | |
| 4,876,841 | A * | 10/1989 | Jensen | B65D 71/0096 108/55.1 |
| 5,450,979 | A * | 9/1995 | Servick | B65D 81/365 206/217 |
| 5,676,482 | A * | 10/1997 | Hawkins | B42D 1/08 281/31 |
| 5,950,820 | A * | 9/1999 | Heinze, IIII | B65D 75/32 206/232 |
| 6,432,500 | B1 * | 8/2002 | Jones | G09F 3/0289 283/101 |
| 2003/0207000 | A1 * | 11/2003 | Merriman | A23B 4/16 426/124 |
| 2005/0153091 | A1 * | 7/2005 | Challoner | G09F 3/10 428/42.3 |
| 2007/0102308 | A1 * | 5/2007 | Tremblay | B65D 11/04 206/223 |
| 2009/0000968 | A1 * | 1/2009 | Smith | B65D 75/5838 206/264 |
| 2014/0332434 | A1 * | 11/2014 | Regas | B65D 23/085 206/459.5 |

OTHER PUBLICATIONS

Claims as filed as search in corresponding EPO Application No. EP17165372.8, and to which the EPO Search Report is directed.
EPO Search Report dated Oct. 23, 2017 in corresponding EPO Application No. EP17165372.8.

* cited by examiner

FIG. 15
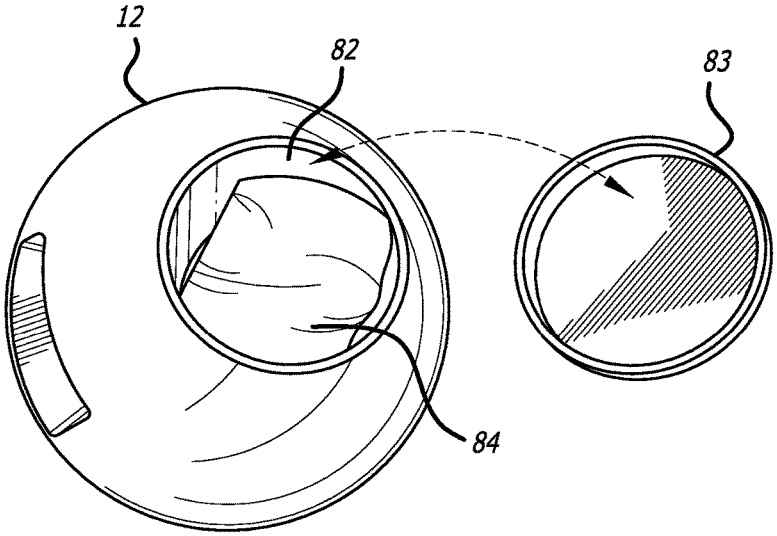
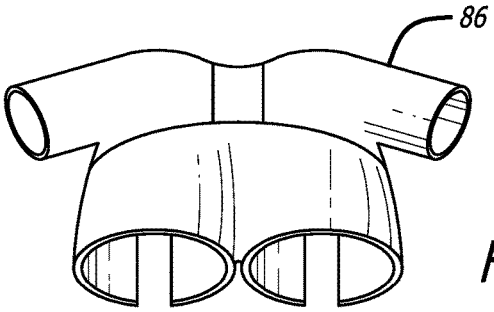
FIG. 16

TOY HAVING MULTIPLE SERIAL SURPRISE REVEALS

CROSS-REFERENCE TO RELATED APPLICATIONS

This application claims benefit of U.S. provisional patent application No. 62/447,274 filed Jan. 17, 2017.

BACKGROUND OF THE INVENTION

1. Field of the Invention

This invention relates to the field of toys. More particularly, this invention relates to the field of a toy having multiple layers of unwrapping that are serially removed to successively reveal the different parts of the toy, thus providing multiple surprise reveals.

2. Description of Related Art

Children enjoy surprises, and enjoy toys that contain an element of surprise. U.S. Patent Publication No. 2002/0168919 by Perkins discloses a plush toy having a prize hidden in an interior compartment. Other toys that contain surprises inside include hollow plastic Eastern eggs inside of which is hidden a candy or a toy figure.

SUMMARY OF THE INVENTION

The present invention is of a toy having multiple serial surprize reveals.

In an exemplary embodiment, the toy is in the shape of a sphere, and has multiple layers of a flexible shape-conforming wrapping over it. As each layer of wrapping is removed a different play object such as a printed collectible card is revealed. Additionally, the sphere has multiple recesses in it defining respective outer compartments. One outer compartment may be revealed for each of several layers of wrapping removed. This is accomplished by having the wrappers take the form of bands that cover less than all of the sphere, with the bands aligned at angles relative to the adjacent band(s). Inside each outer compartment lies another play object, such as a pair of shoes for a doll, or a jacket for a doll, or an accessory for the doll. Those play objects may be wrapped in their own opaque or translucent bags. Finally, when all of the layers of wrapping are removed, the entire shell of the sphere is revealed. The shell comes apart into two pieces, revealing an inner compartment within the shell. Inside the inner compartment is another play object, such as a doll onto which the shoes and the jacket fit. The doll may also be contained within its own opaque or translucent bag.

In this way, the child experiences multiple "reveals" in serial, disclosing a hidden prize or play object with each new reveal, and thus generating excitement with each reveal, and with at least some of the prizes having a play relationship to each other such as clothes that fit on a doll, accessories for the dolls, hints about the doll's identity or characteristics, and/or instructions describing how to use the doll.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

BRIEF DESCRIPTION OF THE DRAWINGS

FIGS. 1-18 are illustrations of a first embodiment of the toy being unwrapped and opened, showing the various portions thereof being serially revealed to the user.

FIG. 1 is a rear view of a first exemplary embodiment of the toy in its fully wrapped and unrevealed state.

FIG. 2 shows the front view of the toy of FIG. 1.

FIG. 3 shows the child in the process of removing the first wrapper from the toy.

FIG. 4 shows a first hidden play object after it has been revealed and removed from the rest of the toy.

FIG. 5 shows the toy after the first wrapper has been removed, and as the child is beginning to remove the second wrapper.

FIG. 6 shows the toy as the second wrapper is being removed by the child.

FIG. 7 shows a second hidden play object after it has been removed from the rest of the toy.

FIG. 8 shows the toy after the third flexible wrapper has been removed to reveal a first exterior compartment, and the child is removing a first bag which had been hidden therein.

FIG. 9 shows a first hidden toy after it has been removed from the first bag.

FIG. 10 shows the child removing a second bag that was hidden inside the second exterior compartment.

FIG. 11 shows the sphere of the toy and its second exterior compartment, and also shows a second toy that was contained in the second bag.

FIG. 12 is a conceptual drawing that illustrates two wrappers and the two exterior compartments in the sphere which those wrappings respectively covered.

FIG. 13 shows the child removing a fifth flexible wrapper.

FIG. 14 shows the sphere after the fifth flexible wrapper has been removed to reveal a cover which covers a third exterior compartment.

FIG. 15 shows the cover removed from the shell to reveal a third bag hidden in the third exterior compartment.

FIG. 16 shows the fifth play object, which is clothing for a doll, that was hidden inside the third bag.

FIG. 17 shows the shell after it has been completely unwrapped and opened, revealing a fourth bag therein.

FIG. 18 shows a sixth play object, which is a doll, being removed from the fourth bag.

DETAILED DESCRIPTION OF THE INVENTION

The following is a description of merely one possible embodiment of the invention.

Figure 1:
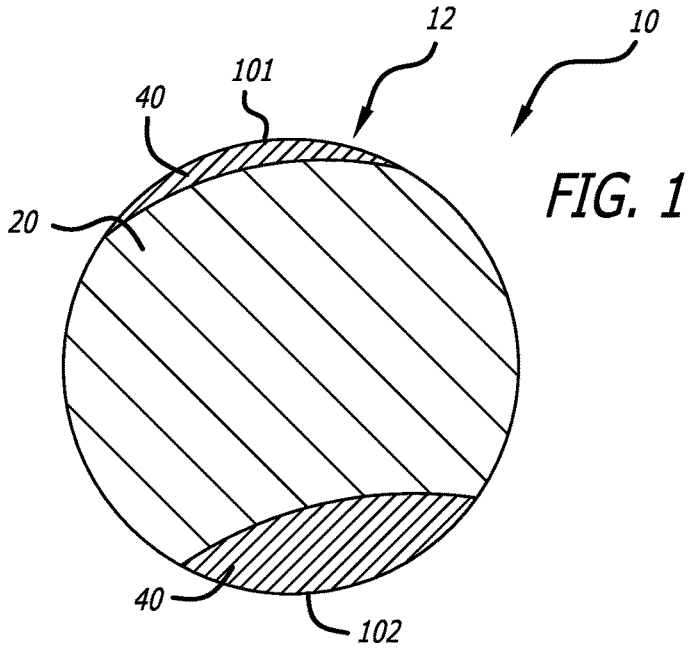

FIG. 1 is a rear view of a first exemplary embodiment of the toy 10 in its fully wrapped and unrevealed state. In this embodiment the toy 10 has a generally spherical shape and thus generally takes the form of a ball or sphere 12. The sphere 12 is a generally spherical and generally hollow shell 14 surrounded by a number of flexible wrappers 20, 40 and others not shown in this figure, that generally conform in shape to the outer surface of the sphere 12. Shell 14 thus forms a core around which the wrappers are wrapped. The wrappers may comprise shrink wrap plastic so that they conform to the outer surface.

Figure 5:
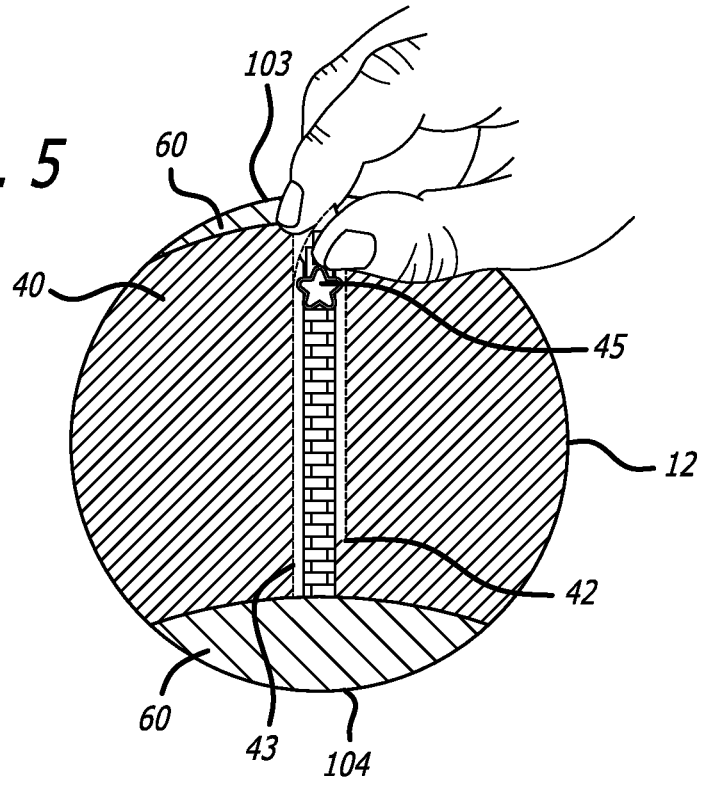

The figure shows the outermost flexible wrapper 20 which covers a majority of the sphere 12 but does not cover a first end 101 of the sphere and does not cover second end 102 of the sphere opposite first end 101. Second flexible wrapper 40 is partially visible over sphere ends 101 and 102. Second wrapper 40 covers most of core 14 but not sphere ends 103 and 104 (FIG. 5). Both wrappers 20 and 40 define bands that cover most of the core 14 but not all of it. Wrappers 20 and 40 are aligned at an angle to one another such that they cover different parts of core 14. More specifically, wrappers 20 and 40 are aligned orthogonally or 90° relative to one another, although they could be aligned at other angles.

Figure 2:
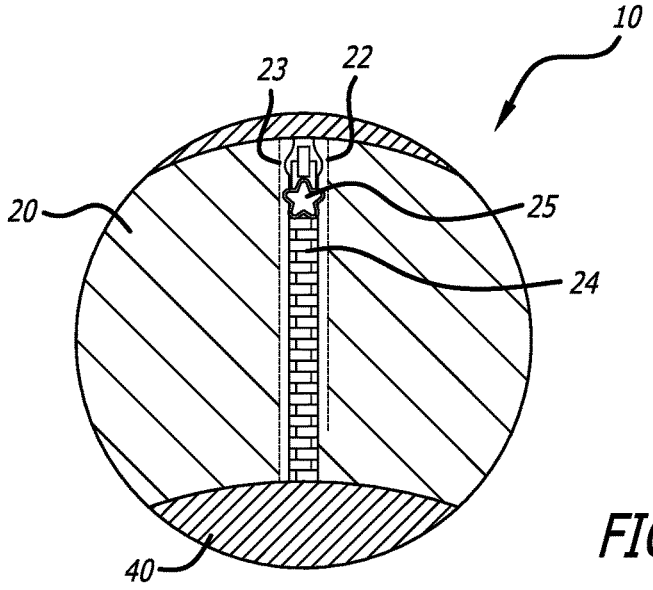

FIG. 2 shows the front view of the toy 10 of FIG. 1. First wrapper 20 includes two lines of perforations 22, 23 and a printed image of a zipper on a strip 24 that is located between the perforation lines. Strip 24 has a tab 25 which the child can easily grasp. A perforation line is one type of weakened separation line. More generally, wrapper 20 has at least one weakened separation line 22, and an image of a zipper or other closure mechanism proximate the weakened separation line. Other types of weakened separation lines include a partial die cut.

To remove wrapper 20, the child grasps tab 25 and pulls it downward to separate the wrapper along perforations 22, 23. This action is similar for the child to pulling a zipper down. The printed image of the zipper thus adds to the child's play experience.

Figure 3:
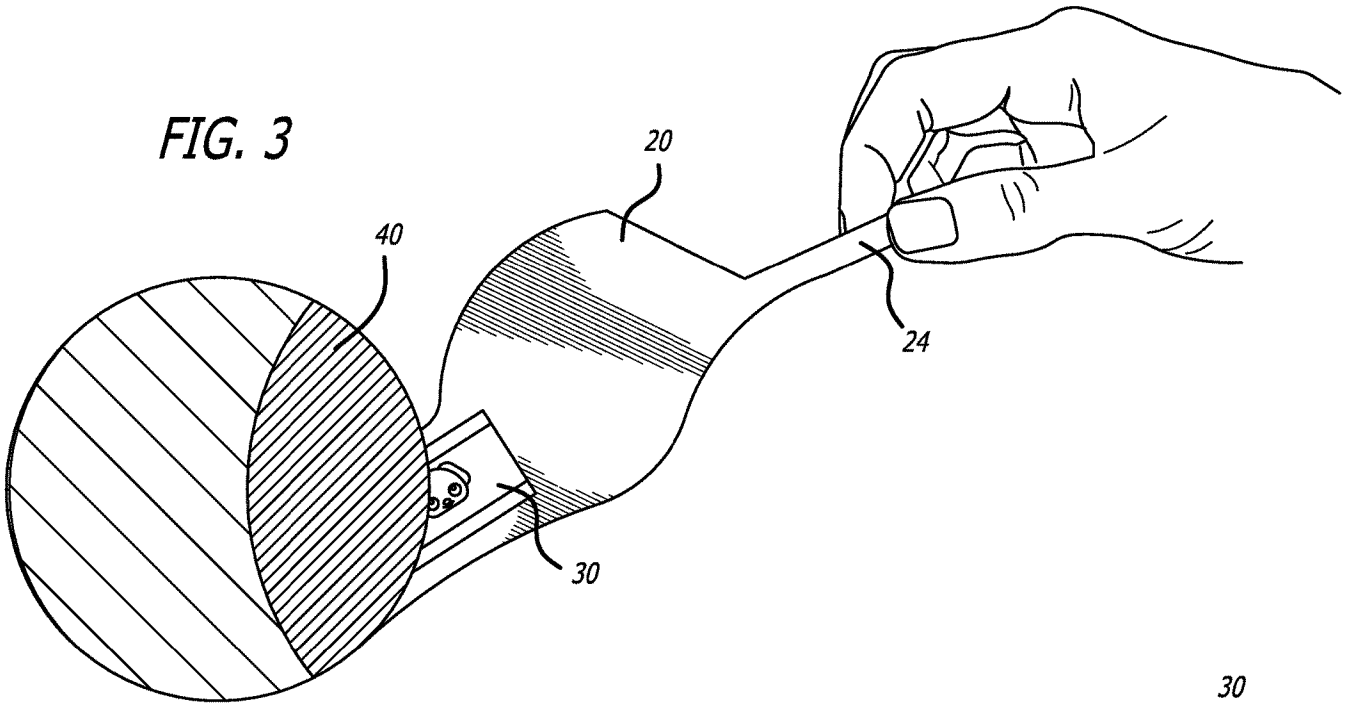

FIG. 3 shows the child having pulled down strip 24 and partially removed first wrapper 20. Hidden under first wrapper 20, and thus disposed between the outer wrapper 20 and the core 14 and any more inward wrapper 40, lies a first play object 30. The revealing of the first play object 30 constitutes a first surprise reveal. In this embodiment the first play object 30 is disposed immediately between and adjacent to outer wrapper 20 and inner wrapper 40.

Figure 4:
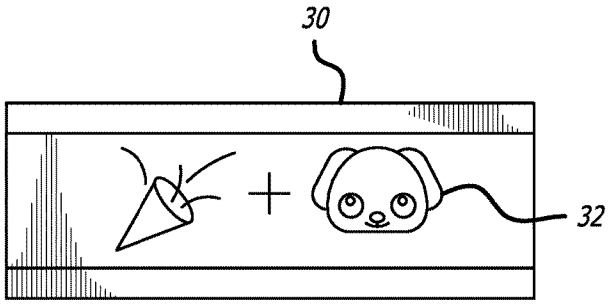

FIG. 4 shows first hidden play object 30 after it has been removed from the rest of the toy. In this embodiment, first play object 30 is a written play object, and more particularly a card having printed indicia 32 on it. First play object 30 and printed indicia 32 thereon bear a play relationship with other parts of the toy that have yet to be revealed. As examples, the first play object can be any of, or contain any of: a hint regarding an identify of another play object that is part of the toy, a collectable card, a puzzle piece, a card containing information about the toy including the character 96 hidden inside (FIGS. 18-19), or printed illustrations and/or directions for using the toy. Still further, the card could be a card containing a URL and/or password to be used on the Internet, allowing the child to gain access to information, games, offers, or other content on the Internet.

In this example, the card 30 contains printed indicia 32 that constitutes a hint. The hint in this case is properly read is "party animal," indicating that the doll and clothing inside the toy will have a party theme. The card 30 acts as a teaser, giving the child a teaser about what is to follow.

The first surprise reveal can thus help to build excitement and anticipation in the child for other reveals to come.

FIG. 5 shows the toy after the first wrapper 20 has been removed, and as the child is beginning to remove the second wrapper 40. The second wrapper 40 can have similar perforation lines 42, 43, the printed image of a zipper, and tab 45 to facilitate removal of the second wrapper, similar to first wrapper 20. The second wrapper 40 covers most of the core 14 but does not cover opposite sphere ends 103, 104, which are different ends than 101, 102. Third flexible wrapper 60, which is disposed underneath second flexible wrapper 40 and aligned at an angle to it, is visible at sphere ends 103, 104. Because wrapper bands 20, 40 are aligned at angles to one another, sphere ends 101, 102 that are not covered by first wrapper 20, are different sphere ends than sphere ends 103, 104 which are not covered by second wrapper 40.

Figure 6:
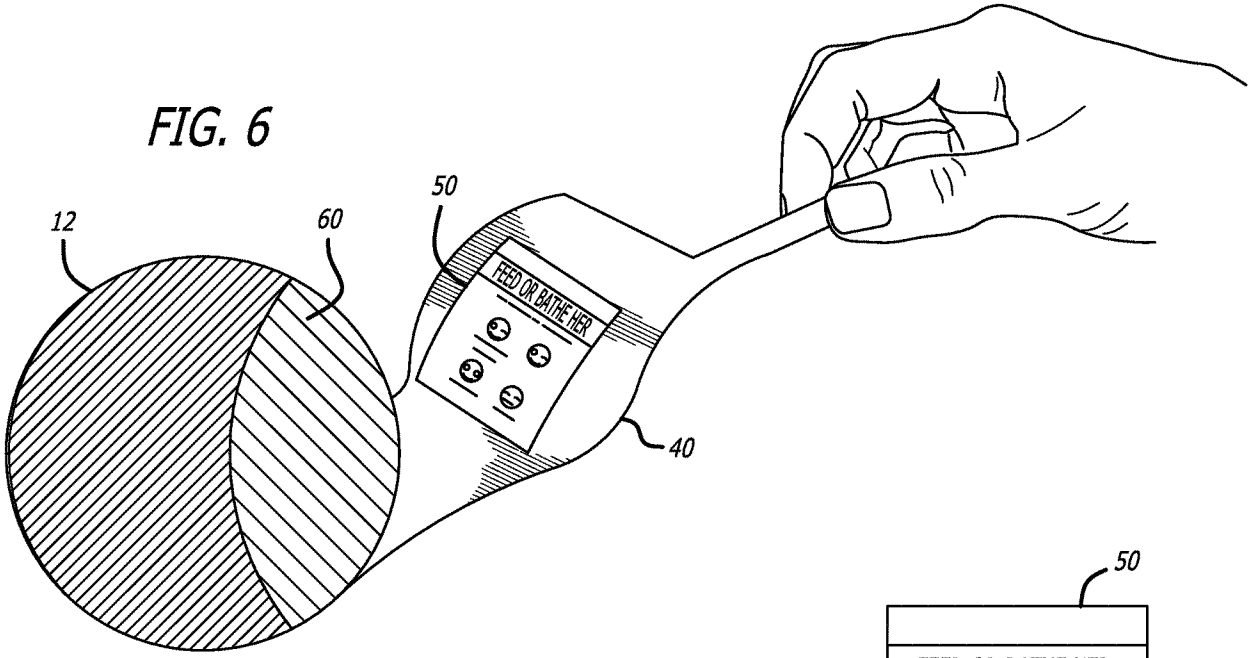

FIG. 6 shows the sphere 12 as second wrapper 40 is being removed by the child. Second surprise or play object 50 is visible. The second surprise reveal further helps to build excitement and anticipation in the child for other reveals to come. Third flexible wrapper 60 is partially visible.

In this embodiment, second play object 50 is a second written play object, and more particularly a card having printed indicia 52 on it. Second play object 50 and printed indicia 52 thereon bear a play relationship with other parts of the toy that have been revealed or have yet to be revealed. As with the first play object 30, the second play object 50 can be any of, or contain any of: a hint regarding an identify of another play object that is part of the toy, a collectable card, a puzzle piece, a card containing information about the toy including the character 96 hidden inside (FIGS. 18-19), or printed illustrations and/or directions for using the toy. Still further, the card could be a card containing a URL and/or password to be used on the Internet, allowing the child to gain access to information, games, offers, or other content on the Internet.

Figure 7:
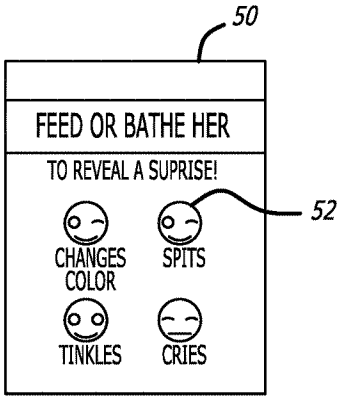

FIG. 7 shows second play object 50 after it has been removed from the rest of the toy. In this particular example, printed indicia 52 contains an indicator regarding a characteristic of the toy doll inside. More particularly, printed indicia 52 discloses, "Feed or Bath her to reveal a surprise," and that the doll then changes color, spits, tinkles, and/or cries.

Figure 8:
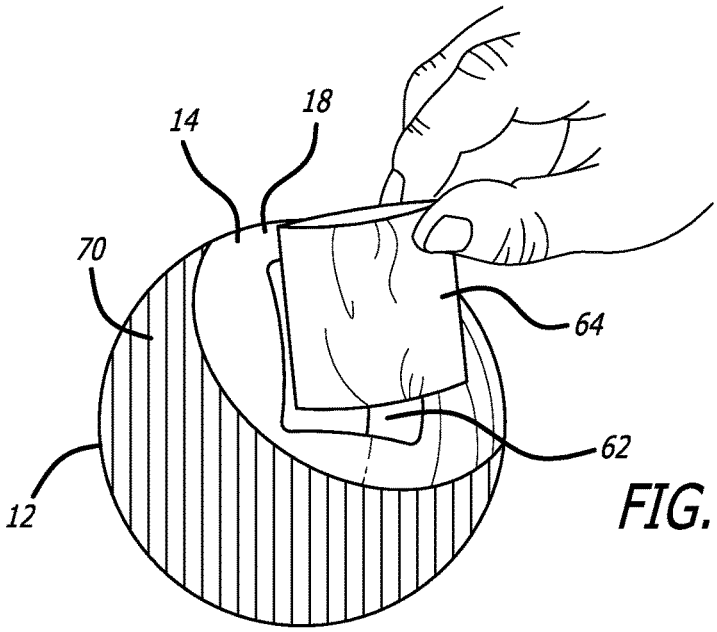

Underneath the first and second wrappers 20, 40 lies a third flexible wrapper 60. Third flexible wrapper 60 is structured and removed similarly to the first and second flexible wrappers 20, 40. The third flexible wrapper 60 is angled relative to second flexible wrapper 40 to cover a different part of sphere 12, similar to the way that second flexible wrapper 40 was angled relative to first flexible wrapper 20. When the third flexible wrapper 60 is removed, a first outer or exterior compartment 62 formed by a recess in the outer surface 18 of sphere 12 is revealed. As seen in FIG. 8, the recess formed in shell 14 of sphere 12 extends inwardly from shell 14, toward an interior area of sphere 12. As seen in the figure, the recess which defines outer compartment 62 extends circumferentially for a distance of less than half a circumference of sphere 12. Likewise, As seen in FIGS. 8, 10, 12, 14, and 15, the recesses which define compartments 72, and 82 extend circumferentially for a distance of less than half a circumference of sphere 12.

FIG. 8 shows the sphere 12 after the third flexible wrapper 60 has been removed to reveal first exterior compartment 62, and the child is removing bag 64 which had been hidden inside first exterior compartment 62. The revealing of bag 64 constitutes a third surprise reveal.

Bag 64 is preferably a "blind bag," meaning that the bag cannot be seen through or cannot be easily seen through. It is not transparent. It is opaque or translucent. The bag being a blind bag adds another layer of surprise reveals to the toy. The child opening the blind bag thus constitutes another surprise reveal. Inside the bag is a third play object 66. In this case third play object 66 is a first toy.

Figure 9:
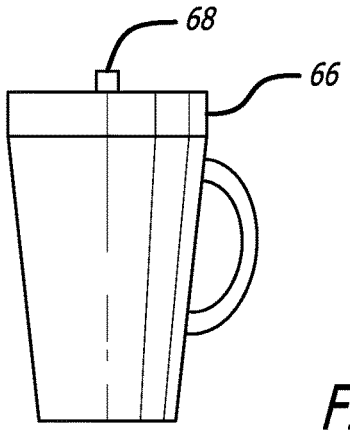

FIG. 9 shows first toy 66 that had been hidden after it has been removed from bag 64. In this case first toy 66 is a baby bottle having a spout or nipple 68 that fits the mouth of the doll that is hidden inside the sphere and is yet to be revealed. The third play object 66, i.e. the first toy, therefore bears a play relationship with the other play objects that a part of the overall toy 10.

After the third flexible wrapper 60 has been removed to reveal first exterior compartment 62, a fourth flexible wrapper 70 is also now fully visible. The fourth flexible wrapper 70 is preferably aligned at an angle relative to the third flexible wrapper, and is also aligned at an angle relative to fifth flexible wrapper 80 (FIG. 10) below it.

The fourth flexible wrapper 70 is structured and removed similarly to the previous flexible wrappers. Underneath the fourth flexible wrapper 70 lies a second exterior compartment 72 that is also defined by a recess formed in the exterior of shell 14 and extending inwardly therefrom, similar to first exterior compartment 62 but spaced apart from first exterior compartment 62. First and second exterior compartments 62 and 72 are thus positioned at different locations on shell 14, and are covered by different wrappers. Removing the third wrapper 60 that conceals first exterior compartment 62 reveals that compartment but does not reveal second exterior compartment 72. Rather, second exterior compartment 72 remains hidden until fourth flexible wrapper 70 is removed. The child removing fourth flexible wrapper 70 to reveal compartment 72 constitutes an additional surprise reveal.

Figure 10:
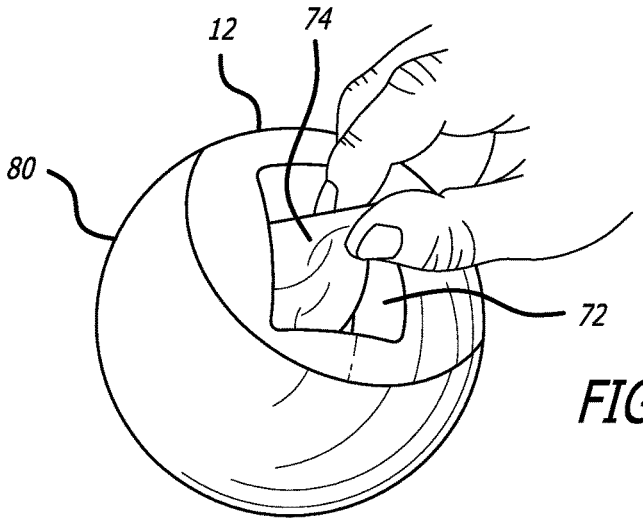

FIG. 10 shows the child removing a second bag 74 that was lying hidden inside second exterior compartment 72. Like the first bag 64, second bag 74 is preferably non-transparent, such as translucent or opaque. The child opening bag 74 constitutes an additional surprise reveal. Inside bag 74 is a fourth play object 76.

Figure 11:
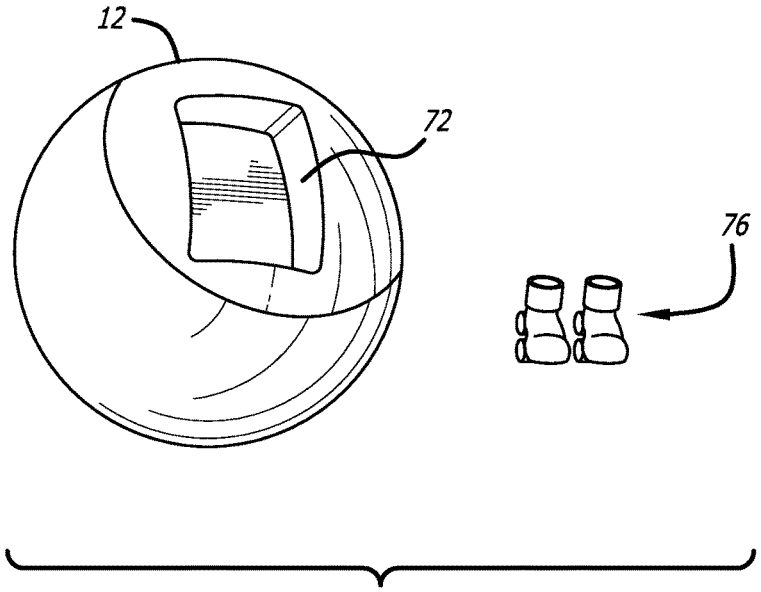

FIG. 11 shows sphere 12 and its second exterior compartment 72, and also shows fourth play object 76 which in this case is a second toy, and more particularly is a pair of toy roller skates 76. The second toy 76 bears a play relationship with the other play objects including the doll which is hidden inside sphere 12. More particularly, roller skates 76 fit on the feet of the doll.

The child is now ready to remove fifth flexible wrapper 80, in a similar manner to the way the child removed the first four flexible wrappers 20, 40, 60, 70. Fifth wrapper 80 is preferably angled relative to fourth wrapper 70 above it.

Figure 12:
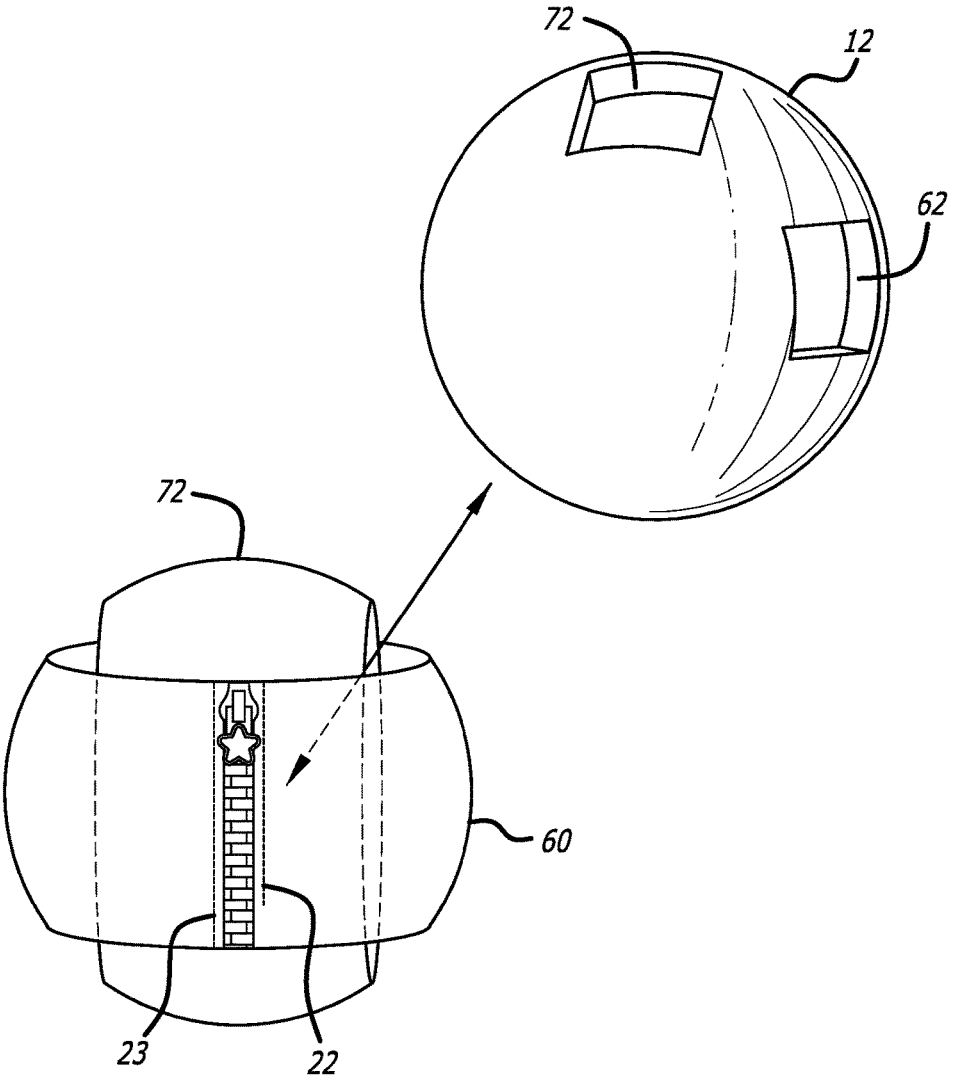

FIG. 12 is a conceptual drawing that illustrates just two wrappers 60, 70 and the two exterior compartments 62, 72 in sphere 12 which those wrappings respectively cover. This figure illustrates perhaps most clearly how two wrappers 60, 70 that each cover less than the entire surface of sphere 12 and which are angled with respect to one another, can cover different compartments 62, 72 formed as recesses in the exterior surface of the sphere, such that serially removing the wrappers serially reveals the compartments.

Figure 13:
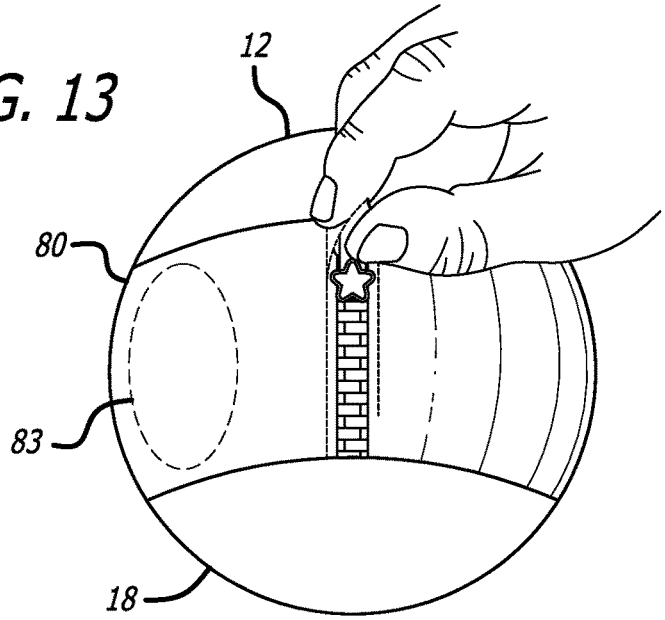

FIG. 13 shows the child removing fifth flexible wrapper 80. A lid 83 which lies below fifth wrapper 80 is drawn in phantom to show its position underneath that wrapper.

Figure 14:
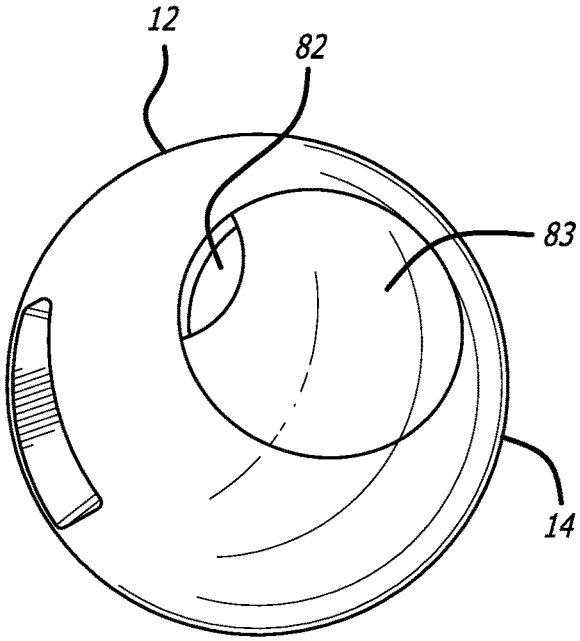

FIG. 14 shows sphere 12 after fifth flexible wrapper 80 has been removed to reveal cover or lid 83 which covers third exterior compartment 82 below the cover. As with first and second interior compartments 62 and 72, third exterior compartment 82 is defined by a recess formed in the exterior of shell 14 and extending inwardly therefrom. Cover 83 generally conforms to the overall shape of shell 14. Now that fifth wrapper 80 has been removed, the entire shell 14 is revealed.

FIG. 15 shows cover 83 removed from shell 14 to reveal a third bag 84 hidden inside compartment 82. The revealing of third bag 84 constitutes an additional surprise reveal. Third bag 84 is preferably non-transparent, such as translucent or opaque. Opening third bag 84 constitutes an additional surprise reveal.

FIG. 16 shows fifth play object 86 that was hidden inside third bag 84. In this case, the fifth play object 86 defines a third toy, and more particularly an article of clothing for the doll that has yet to be revealed. The article of clothing 86 in this example is a vest and shorts that fit on the doll. The fifth play object thus has a play relationship to the doll within, and also to the other play objects that have been revealed.

Now that all of the wrappers have been removed, the shell 14 that defines the sphere 12 is completely unwrapped is ready to be opened to reveal the toy within. Shell 12 can have an opening mechanism that allows the shell to be opened thereby revealing an inner compartment. The opening mechanism can include a hinge, a latch, or in this case, simply a loose interference fit between two halves of the shell, allowing a user to twist the top half while holding the bottom half, thus allowing the two halves to come apart, similar to how a typical hollow plastic Easter egg comes apart.

Figure 17:
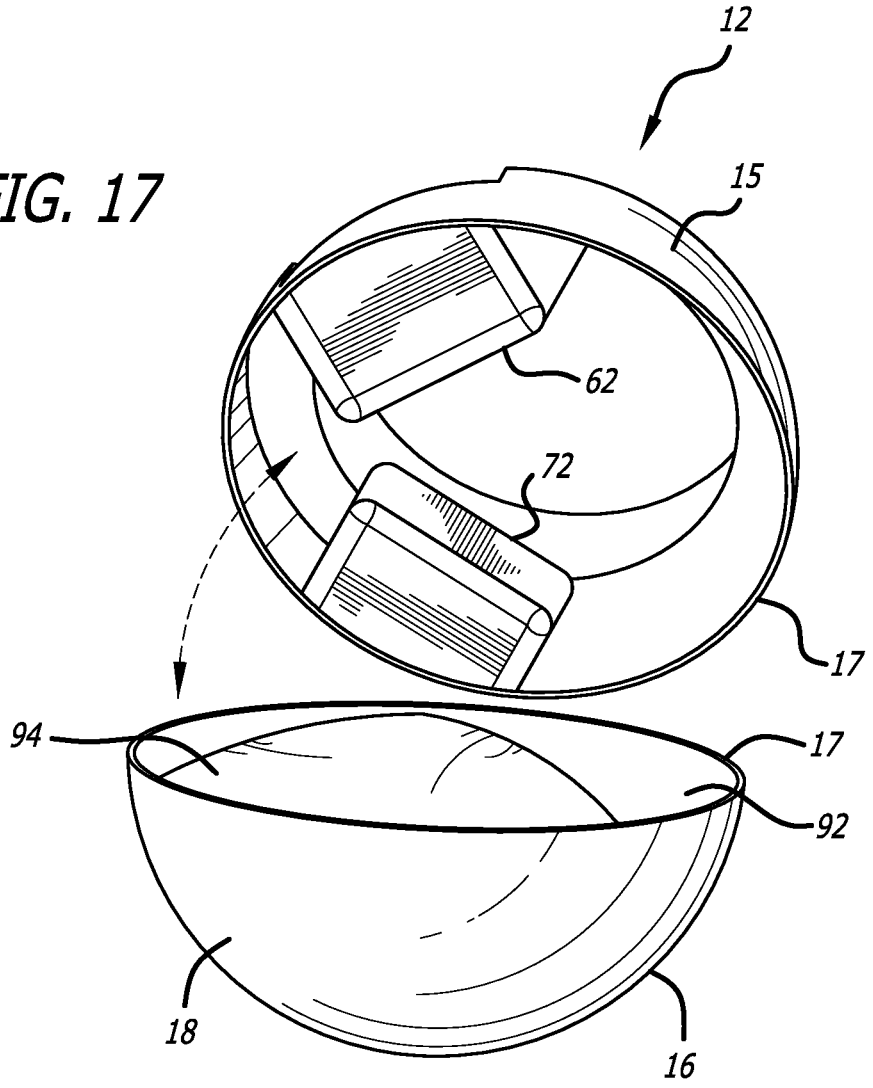

FIG. 17 shows shell 14 after it has been opened. Shell 14 consists of two hemispheres 15, 16, the two shells coming together at common equator 17. The two hemispheres have a loose interference fit to hold them together, with only a small force needed to separate them so that a child can separate the two hemispheres. The fourth flexible wrapper 80 may have been aligned such that it covered all of equator 17, or only part of equator 17, and portions of hemispheres 15, 16 that were adjacent to the equator.

The walls that define exterior compartments 62, 72 can be seen in top hemisphere 15. Opening the shell constitutes yet another surprise reveal.

The inside of shell 14 defines an interior compartment 92. Interior compartment 92 contains a fourth bag 94 which is preferably non-transparent. Opening fourth bag 94 constitutes another surprise reveal.

Figure 18:
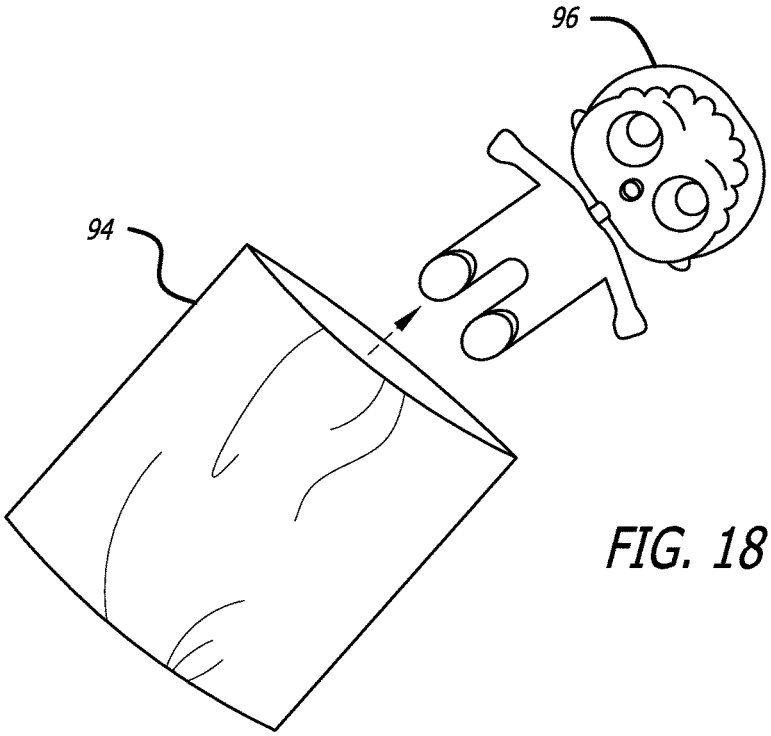

FIG. 18 shows a sixth play object or fourth toy 96, which in this example is a doll, being removed from fourth bag 94. In this example sixth play object 96 is a doll, but more generally it could be a character figure such as a human, animal, robot, etc.

Additionally, the toy could contain other surprises including in other blind bags. For example, in addition to containing fourth bag 94 in which doll 96 is found, the interior compartment 92 could contain a fifth blind bag (not shown) containing an additional accessory (not shown) for the doll. The fourth and fifth blind bags could be separate bags, or one bag could be contained within the other.

Figure 19:
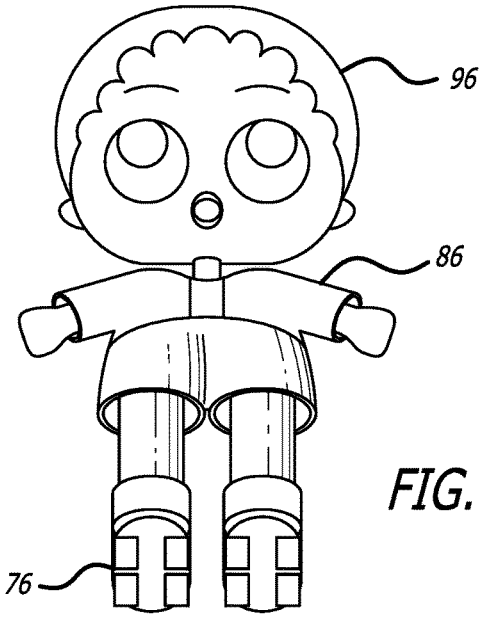
FIG. 19 is a view of the doll wearing the garment and the roller skates which had been hidden within the exterior compartments.

FIG. 19 is a view of the doll 96 wearing garment 86 and roller skates 76 which the child has placed onto the doll.

As foreshadowed by second written card 50, when a child fills baby bottle 66 with water and uses it to feed water to doll 96 through an opening in the doll's mouth, and then doll 96 is squeezed, doll 96 performs one of changing colors, spitting, tinkling, or crying. In this example, squeezing the doll makes the doll spit the water back out through its mouth.

In this way, the various interrelated parts of the toy are serially revealed to the child as she removes the various layers of wrapping from the toy and its components. This engages and excites the child more than if she were to merely open a single package containing the doll and all of its clothing and accessories, and all of the written material associated with the doll. Toys 66, 76, 86, 96 all define hidden toys that get serially revealed to the child as she removes the various wrappings.

The exemplary embodiment illustrated includes a doll, articles of clothing or other accessories for the doll, and information about the doll. In other embodiments, and as merely a few examples, the different play objects could include different articles of toy jewelry, different charms or other components for making jewelry, different toy cars, different toy characters, or different pieces of a space ship or transformer character. More generally, as long as there is some play relationship between the surprises that are revealed, the child is more engaged and her interest and excitement are held longer than if the child were to merely open one box containing all of the play pieces and the associated instructions and information inside.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, the core of the toy around which the wrappings are wrapped could take forms other than a hollow sphere, and some of the wrappings could completely cover the core. The wrappings could also cover only a small band of the core, rather than most of it. Further, the wrappings need not be identical as in the illustrative embodiment. Other variations will be apparent to toy designers of ordinary skill. Accordingly, it is to be understood that the detailed description and the accompanying drawings as set forth hereinabove are not intended to limit the breadth of the present invention, which should be inferred only from the following claims and their appropriately construed legal equivalents.

Within the claims that follow, the ordering of the play objects as first play object, second play object, etc., differs from the ordering as described in the description above. Generally speaking, in the claims that follow the play object within the center of the toy has been reordered as the "first play object," and the play objects that are located outwardly from the center have been reordered as the "second play object," then the "third play object," etc. This reordering has been done to make the language of the claims read more naturally, and is not intended to affect the scope of the claims. Furthermore, in some claims the ordering of the wrappers follows the ordering as set forth above, and in some claims the ordering of the wrappers has been reversed to make the language of the claims read more naturally.

We claim:

1. A toy having a surprise within, the toy comprising:

a generally spherical hollow shell, the shell generally defining a sphere, the shell comprising separable first and second hemispheres, the first and second hemispheres meeting along an equator of the shell;

a first flexible wrapper at least partially covering the equator and respectively adjacent portions of the first and second hemispheres, the first flexible wrapper covering some but less than ail of the hemispheres such that at least opposite first and second end portions of the sphere are not covered by the first flexible wrapper;

a weakened separation line in the first flexible wrapper to facilitate tearing the first flexible wrapper along the weakened separation line and removing the first flexible wrapper from around the shell;

a toy figure inside the shell, the toy figure being accessible by a user tearing the first flexible wrapper along the weakened separation line, removing the first flexible wrapper, and separating the hemispheres; and a second flexible wrapper disposed outward of the first flexible wrapper, the second flexible wrapper covering part of the sphere but not covering third and fourth end portions of the sphere;

wherein:

the second flexible wrapper is aligned at an angle that is offset from the first flexible wrapper;

the shell has an outer surface and a first recess formed in the outer surface, the first recess containing a first play object, the first recess being covered by the first flexible wrapper such that when a user removes the first flexible wrapper the first play object is revealed;

the outer surface of the shell has a second recess formed in the outer surface, the second recess containing a second play object, the second recess being covered by the second flexible wrapper such that when a user removes the second flexible wrapper the second play object is revealed; and the offset angle between the first and second flexible wrappers is such that:

the first flexible wrapper does not extend over the second recess; and the second flexible wrapper does not extend over the first recess.

* * * * *